US005588823A

United States Patent [19]

Wu

[11] Patent Number: 5,588,823

[45] Date of Patent: Dec. 31, 1996

[54] ALCOHOL LAMP

[76] Inventor: Jung-Wuan Wu, 7F-2, No. 95-8 Chang Ping Road, Sec. 1, Taichung, Taiwan

[21] Appl. No.: 556,411

[22] Filed: Nov. 13, 1995

[51] Int. Cl.[6] ..... F23D 11/44

[52] U.S. Cl. ..... 431/241; 431/230; 126/43; 126/44

[58] Field of Search ..... 431/230, 241; 126/43, 44

[56] References Cited

U.S. PATENT DOCUMENTS 1,433,999 10/1922 Garrison et al. ..... 431/241
1,469,795 10/1923 Knapp ..... 431/230

FOREIGN PATENT DOCUMENTS 366197 4/1922 Germany ..... 431/230

*Primary Examiner*—Carroll B. Dority

[57] ABSTRACT

A novel structure of an alcohol lamp comprises generally a container for containing alcohol therein, a heating pipe and a U-shaped tubular wick adapting capillary attraction to siphon the alcohol up from the container. The heating pipe provide heating source to warm the wick in order to acclerate the vaporization process of the alcohol in the upper portion of the wick and pressurize the vaporized alcohol so as to intensity the flame of the lamp. An adjustment device is provided to control the intensity of the fire. This invention ensures a reliable and economical use of an alcohol lamp.

4 Claims, 4 Drawing Sheets

ALCOHOL LAMP

BACKGROUND OF THE INVENTION

The present invention relates to lamps, more particularly to a structurally improved alcohol lamp in which the flame is adjustable and obviates employing cottonwick.

Prior art alcohol lamp most likely has an alcohol container, a cap and a cottonwick which immerses one end into the alcohol and the other end exposes to outside the cap. By the capillary attraction of the cottonwick, the alcohol is siphoned to it's outward end that is capable being lighted into a flame. Every time, when the alcohol in the container is about exhausted, the outward end of the cottonwick will be burnt out causing freqauent extraction or changing the cottonwick from the lamp. Besides, the flame of this lamp is weak and not adjustable. That's why an advanced structure of the alcohol lamp is currently provided as shown in FIG. 1, in which the lamp comprises an alcohol container 1, a cap 2 including a copper tube 3 which has a pair of extensions 4 stuffed with cottons therein, a pair of nozzles 301 on the top for setting fire and a cup extinguisher 5. This type of alcohol lamp is advantageous to that the nozzles 301 are positioned at the inward surfaces of the tube 3 and symmetrically arranged so as to provide crossfire towards the upper portion of the tube 3 which heats up the tube 3 to accelerate the vaporization of the alcohol therein in order to intensify the flame up to a high degree. This flame is not affected with wind. However, this lamp has numerous disadvantages such that when the alcohol in the container is about exhausted, the cottons inside the tube 3 may be burnt out because the tube 3 becomes white hot instantaneously for the shortage of the vaporized alcohol. It is difficult to change new cottons inside the tube 3 once the cotton is burnt out. Besides, the intensity of fire is also not adjustable, it is otherwise wasting material.

SUMMARY OF THE PRESENT INVENTION

The main object of the present invention is to provide a structurally improved alcohol lamp which the tubular wick obviating the filling up of cotton therein can effectively siphon the alcohol by it's own capillary attraction.

Another object of the present invention is to provide a structurally improved alcohol lamp in which a lever means can be used to adjustably control the flaming direction as well as the intensity of the fire in order achieve economical effect.

Still another object of the present invention is to provide a structurally improved alcohol lamp in which the flame is positioned at the top of the tubular wick that directs to the heated object so as to promote the heating efficiency of the lamp.

Accordingly, the alcohol lamp of the present invention comprises generally a container and a cap member fitted to the opening of the container having a first and second thru holes for respectively inserting a heating pipe and a U-shaped tubular wick therein. A cover in configuration with the cap has similar thru holes thereon aligned with the first and second thru holes of the cover, a circumferential flange and a hollow cylinder protrudent member projected upward from the center thereof for defining a circular space to receive an annular ring and a lever means therein. The annular ring has a splined periphery meshed with the lever means and fixedly sleeves on the heating pipe for rotatably adjusting the flaming direction on the top of the pipe. The U-shaped tubular wick has separately arranged threads of predetermined length stuffed in the lower portion and a plurality of egress holes on the top thereof for blowing out of the vaporized alcohol therefrom. During application, set fire to the heating pipe to heat the tubular wick at first and then light up the tubular wick as the vaporized alcohol in the wick is strong enough to be lighted. Because the fire from the heating pipe blows continuously toward the wick, the vapor of alcohol inside the wick is becoming stronger and stronger so that the flame on the top of the wick is gradually intensified. To rotate the lever means can change the blowing direction of the heating source from the heating pipe for decreasing the temperature on the wick in order to weaken the flame. A cup extinguisher is provided to extinguish the lamp.

The present invention will become more fully understood by reference to the following detailed description thereof when read in conjunction with the attached drawings.

DETAILED DESCRIPTION OF THE PREFERRED EMBODIMENT

Figure 1:
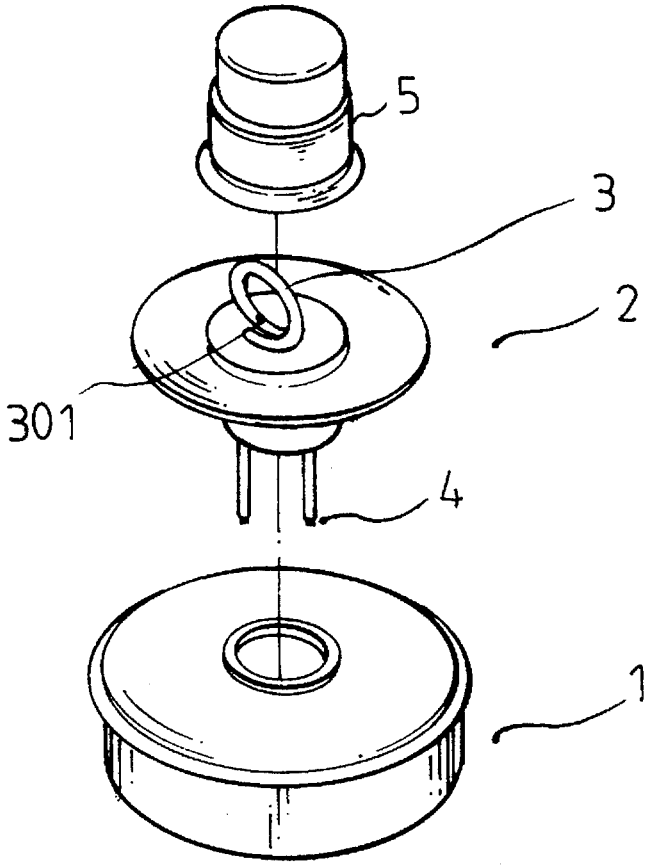
FIG. 1 PRIOR ART
FIG. 1 is an exploded perspective view to show an alcohol lamp of a prior art.
Figure 2:
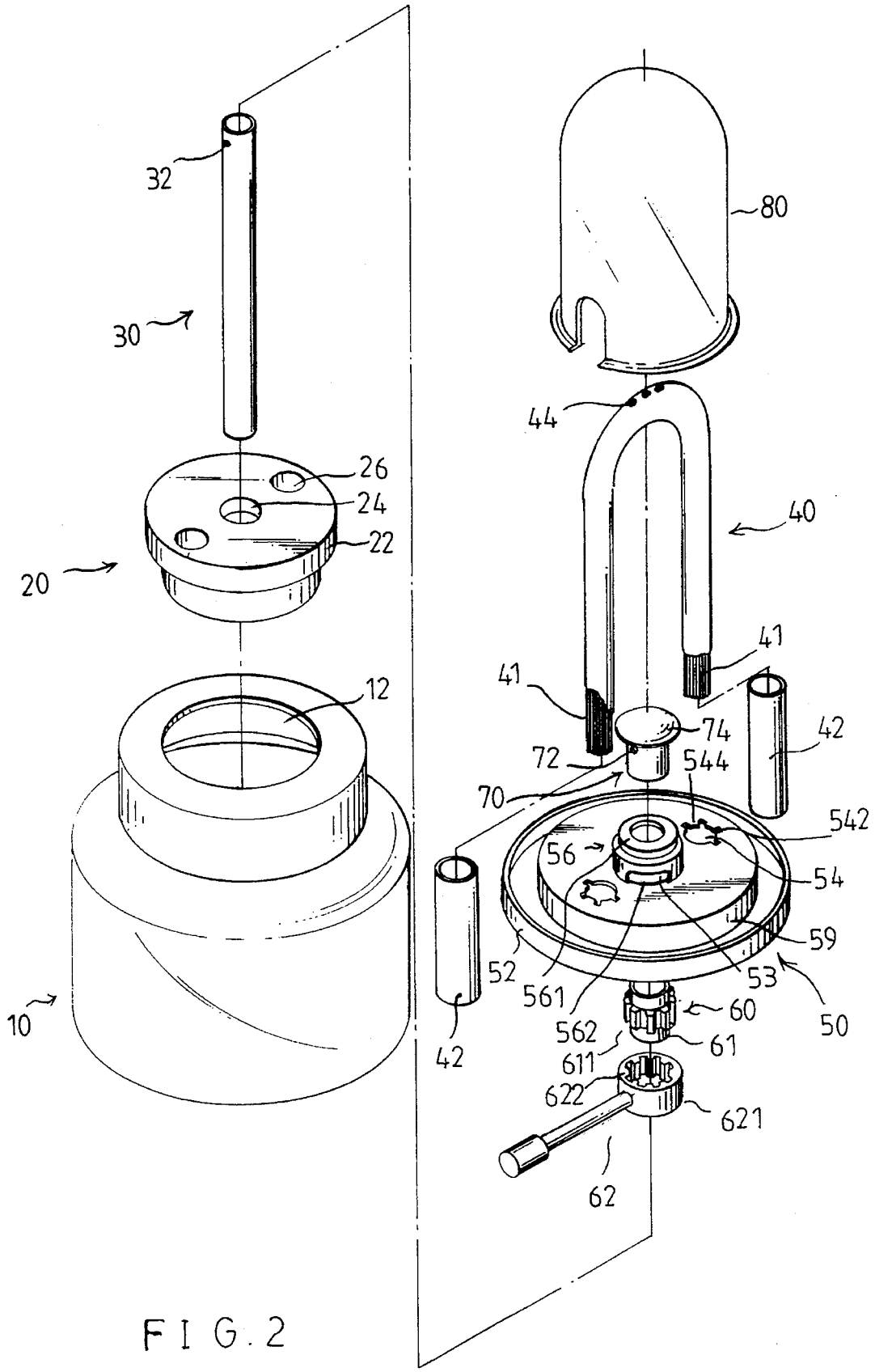
FIG. 2 is an exploded perspective view to show a preferred embodiment of the present invention.
Figure 3:
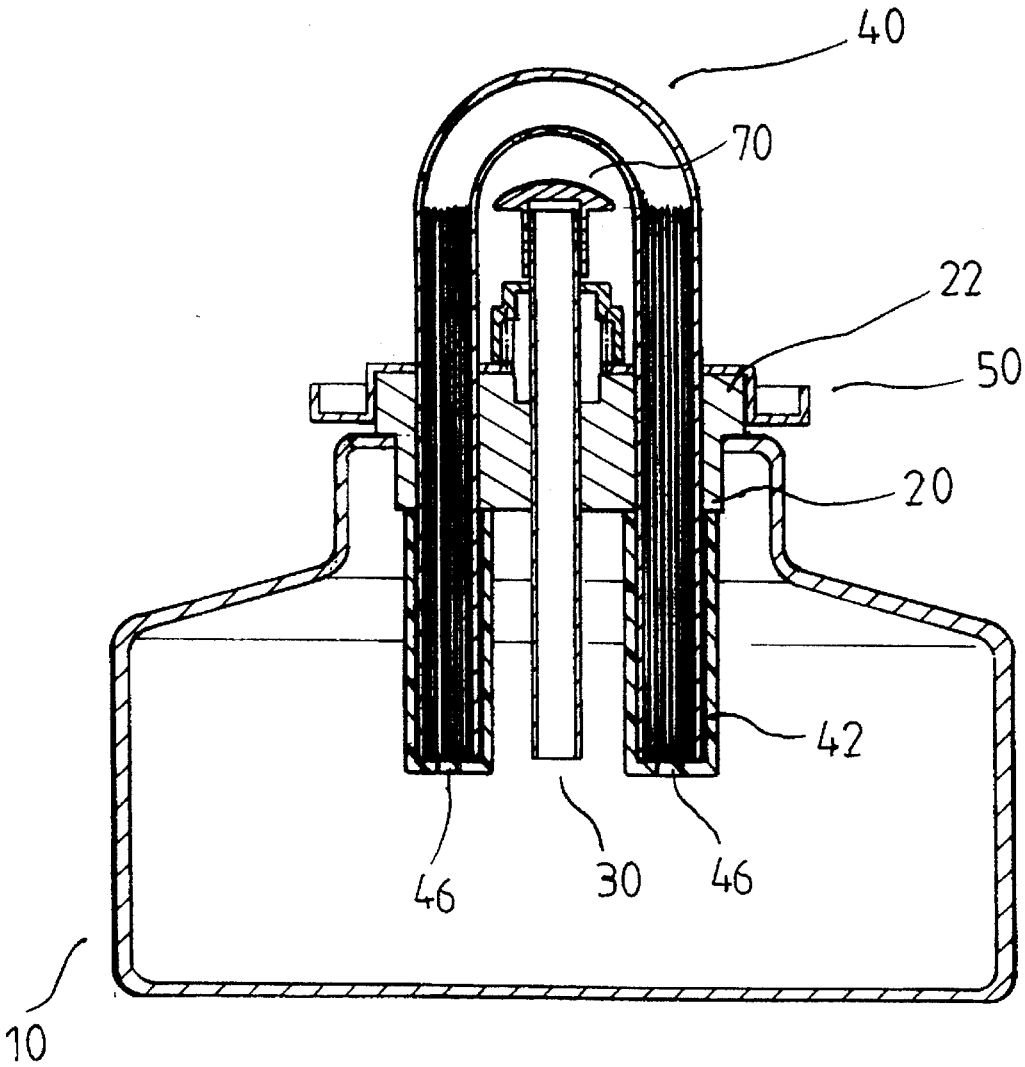
FIG. 3 is an elevational section to show an assembled alcohol lamp of the preferred embodiment of the present invention.

With reference to FIGS. 2 and 3 of the drawings, the alcohol lamp of the present invention comprises generally a cylinder container 10, a circular cap 20, a heating pipe 30, a U-shaped tubular wick 40, a circular cover 50, an adjustment device 60, a sleeve member 70, and a cup extinguisher 80.

The cylinder container 10 for containing alcohol has a less diameter protrudent opening 12 projected upward from the top thereof.

The circular cap 20 has a diameter fitted to the opening 12, a large diameter flange 22 fitted to the upper rim of the opening 12, a first thru hole 24 at the center and a pair of second thru holes 26 symmetrically arranged adjacent the circumference thereof.

The heating pipe has a pair of nozzles 32 symmetrically arranged in the upper periphery thereof.

The U-shaped tubular wick 40 has threads separately arranged with insulative material and stuffed into the lower portion of predetermined length as shown in FIG. 3 and a plurality of egress holes 44 in the top at a central portion. The threads are positioned away from the flame in order to prevent the threads from to be burnt out by the flame.

The circular cover 50 comprises a main body 59 fitted to the cap 20, a circumferential flange 52 of U-shaped section extended outwardly, a central hole 53 and a pair of retaining holes 54 formed in registry with the first and second thru holes 24 and 26 of the cap 20. The retaining holes 54 each has a plurality of incised slots 542 partially made on it's circumference to define a plurality of elastic tabs 544 therearound. A hollow cylinder protrudent member 56 projected upward from the center of the cover 50 to define a circular space therein has a less diameter protrudent central hole 561 on the top aligned with hole 53 and an elongate recess 562 at a lateral periphery which is provided to permit the entrance and lateral movement of a lever means 62. The lever means 62 belongs to the adjustment device 60 which further has an annular ring 61 having splined outer periphery 611 meshed with the vertical grooves around the inner wall of a circular head 621. The adjustment device 60 fixedly sleeves on the heating pipe 30 at an appropriate position and disposes in the circular space of the protrudent member 56.

The sleeve member 70 telescopes on the top of the heating pipe 30 and has a pair of openings 72 symmetrically formed in the periphery and made in registry with the nozzles 32 of the heating pipe 30, and a large diameter flange 74 on the top for preventing the fire from blowing upward.

Figure 5:
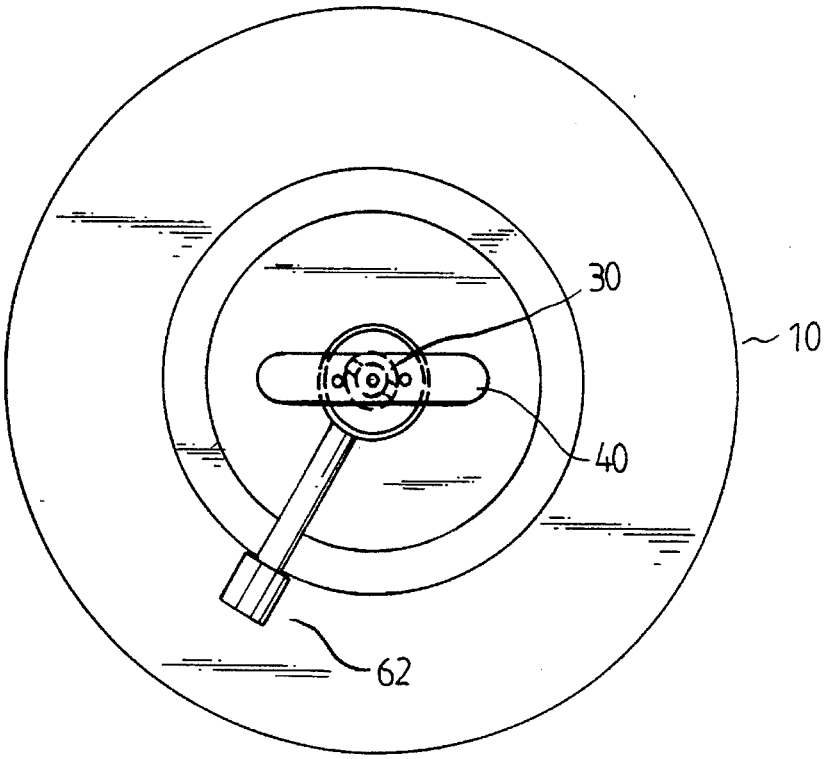
FIG. 5 is a top plane view of FIG. 4.
Figure 4:
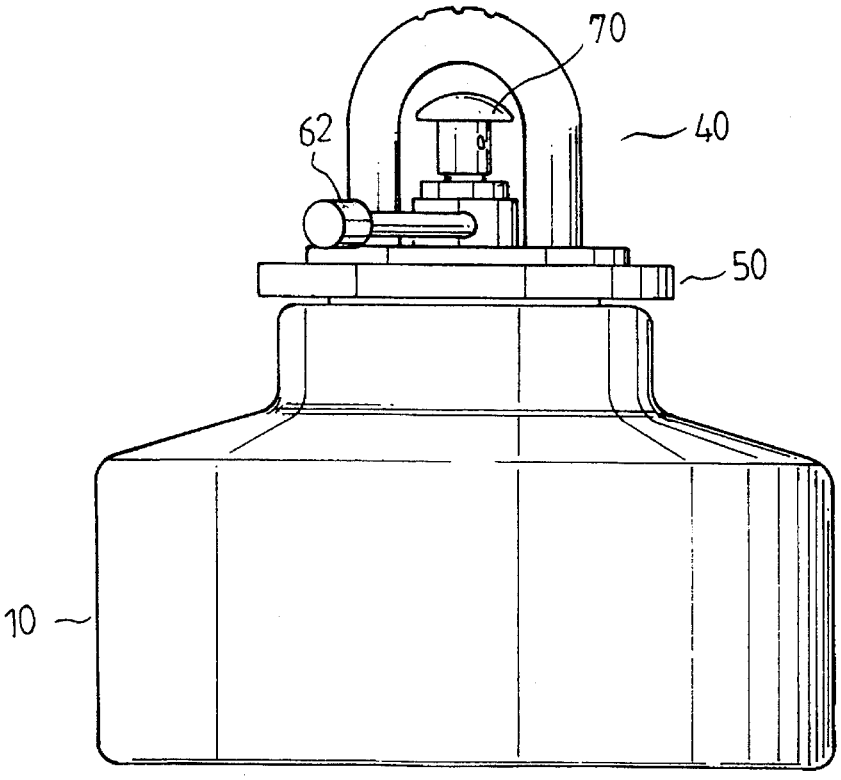
FIG. 4 is a perspective view of FIG. 3.

When assembly, the adjustment device 60 is disposed into the circular space of the protrudent member 56 of the cover 50 at first with the lever means 62 exposed to outside of the elongate recess 562. Secondly, insert the heating pipe 30 through the central hole 561 of the protrudent member 56 into the annular ring 61 of the adjustment device 60 and fixedly sleeve it into an appropriate portion thereof, and then insert the U-shaped tubular wick 40 through the retaining holes 54 where the tabs 544 are pressed to bend sightly downward to provide elastic retaining force to hold the wick 40. A pair of sleeves 42 respectively wrap on the lower portion of the wick 40, which are provided to protect the alcohol inside the container 10 from directly contacted by the wick 40 for preventing the high temperature on the wick 40 from effecting the alcohol in the container. Finally, engage the cover 50 with the cap 20 by inserting the lower portions of the heating pipe 30 and the tubular wick 40 through the first and second thru holes 24 and 26 of the cap 20 respectively, and then press the cap 20 into the opening 12 of the container 10 as the lower portions of the heating pipe 30 and the tubular wick 40 immerse into the alcohol therein.

Where in use, the nozzles 32 of the heating pipe 30 are set fire at first and the flame of the fire becomes a pair of heating sources directly blowing on the U-shaped tubular wick 40 for heating the upper portion of the wick 40, the alcohol which is siphoned upward for the capillary attraction of the threads and gathered at the upper portion of the wick 40 will be vaporized, and the light up the vaporized alcohol at the egress holes 44 on the top of the tubular wick 40 when the vapor expands stronger enough. If the flame is too strong to be adjusted, swing laterally the lever means 62 as shown in FIGS. 4 and 5 to change the blowing direction of the nozzles 32 of the heating pipe 30 that is to keep the heating sources away from the tubular wick 40 for degrading the temperature on the wick 40, so that the flame is weakened because of the degradation of the vapor. A cup extinguisher 80 is provide to extinguish the flame when the alcohol lamp is not in use.

Note that the vacancy on the upper portion of the wick 40 provides sufficient space for vaporization of the alcohol and the heating source accelerates the vaporized process and pressurizes the vapor therein in order to make the flame extremely strong. Further, the flame can be much intensified by increasing the number of egress holes.

Based on aforediscussed improvement, the alcohol lamp of the present invention provides a convenient, economical use to the user who applies an alcohol lamp.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. An alcohol lamp comprising:

a container for containing alcohol having a less diameter protrudent opening projected upward from the top thereof;

a cap member fitted to said opening having a large diameter upper portion fitted to a rim of said opening, a first thru hole at the center and a pair of second thru holes adjacent a circumference of the upper surface;

a cover fitted to said cap member having a large diameter flange of U-shaped section extended outward from a circumferential edge of said cap, a central hole in registry with the first thru hole of said cap member, a hollow protrudent member projected upward from the central hole for defining a circular receiving space therein including a hole aligned with the central hole and a pair of retaining holes made in registry with the second thru holes of said cap member;

a heating pipe inserted through the hole in said protrudent member and the central hole of said cover and the first thru hole of said cap member having a pair of nozzles symmetrically arranged on an upper periphery and a sleeve member telescoped on the top thereof, said sleeve member having a pair of openings on lateral peripheries made in registry with the nozzles of said heating pipe and a large diameter flange on the top thereof;

an adjustment device disposed within the hollow protrudent member of said cover and fixedly wrapped on said heating pipe at an appropriate position having an annular ring of splined outer periphery meshed with a splined inner periphery of a circular head of a lever means which has a lever connected to the circular head and exposed to outside of the hollow protrudent member;

a U-shaped tubular member including a wick insert through the retaining holes of said cover and the second thru holes of said cap, said U-shaped tubular member having a plurality of egress holes on the top, a plurality of separately arranged threads stuffed into a lower portion of predetermined length and a pair of sleeves sleeved on the lower portion thereof.

2. An alcohol lamp as claimed in claim 1 wherein said pair of retaining holes each has partially incised tabs on its inner circumference for providing elastic retaining force to said U-shaped tubular member.

3. An alcohol lamp as claimed in claim 1 wherein said heating pipe and said U-shaped tubular member immerse their lower portions into the alcohol inside said container.

4. An alcohol lamp as claimed in claim 1 further including a cup extinguisher for extinguishing the flame when said lamp is not in use.

* * * * *